US006591607B1

(12) United States Patent
Baumgarten

(10) Patent No.: US 6,591,607 B1
(45) Date of Patent: Jul. 15, 2003

(54) HYDRAULIC MANIPULATOR

(75) Inventor: Klaus Baumgarten, Kirchseeon (DE)

(73) Assignee: LFK - Lenkflugkörpersysteme GmbH, München (DE)

( * ) Notice: Subject to any disclaimer, the term of this patent is extended or adjusted under 35 U.S.C. 154(b) by 0 days.

(21) Appl. No.: 09/857,928

(22) PCT Filed: Dec. 3, 1999

(86) PCT No.: PCT/DE99/03887

§ 371 (c)(1),
(2), (4) Date: Jun. 11, 2001

(87) PCT Pub. No.: WO00/36361

PCT Pub. Date: Jun. 22, 2000

(30) Foreign Application Priority Data

Dec. 12, 1998 (DE) ..... 198 57 378

(51) Int. Cl.[7] ..... F41A 27/26
(52) U.S. Cl. ..... 60/329; 60/475
(58) Field of Search ..... 60/329, 475, 476

(56) References Cited

U.S. PATENT DOCUMENTS

| | | | | | |
|---|---|---|---|---|---|
| 2,036,100 | A | * | 3/1936 | Richbourg | 60/475 |
| 2,780,065 | A | | 2/1957 | Spannhake | |
| 3,903,698 | A | * | 9/1975 | Gellatly et al. | 60/476 |
| 4,325,215 | A | * | 4/1982 | Yamamoto | 417/220 |
| 4,434,709 | A | * | 3/1984 | Grelsson | 91/506 |
| 4,571,941 | A | * | 2/1986 | Aoyagi et al. | 60/435 |
| 4,630,441 | A | | 12/1986 | Chamberlain | |
| 5,215,124 | A | * | 6/1993 | Hattori et al. | 138/26 |
| 5,329,767 | A | * | 7/1994 | Hewett | 60/475 |
| 5,611,259 | A | | 3/1997 | Nagata | |
| 5,916,138 | A | * | 6/1999 | Hild et al. | 60/327 |
| 6,065,288 | A | * | 5/2000 | Glomeau | 60/476 |

FOREIGN PATENT DOCUMENTS

| | | | |
|---|---|---|---|
| DE | 579 089 | | 6/1933 |
| DE | 16 01 738 | | 3/1970 |
| DE | 32 07 904 | | 9/1983 |
| DE | 32 28 655 | | 2/1984 |
| DE | 35 36 858 | | 11/1986 |
| DE | 3536858 | C1 * | 11/1986 |
| DE | 40 22 148 | | 1/1992 |
| DE | 197 16 081 | | 8/1998 |
| GB | 155 279 | | 8/1916 |

* cited by examiner

*Primary Examiner*—Edward K. Look
*Assistant Examiner*—Thomas E. Lazo
(74) *Attorney, Agent, or Firm*—Collard & Roe, P.C.

(57) ABSTRACT

A hydraulic manipulator having an ergonomic handle and good transmission behavior. There is an input drive element of the manipulator which is a hydraulic pump with two conveyance directions. The input drive movement is introduced on the drive shaft of the hydraulic pump as a rotary movement. This device is used in hydraulic manipulators with an input drive element for introducing an input drive movement into a closed hydraulic circuit and a control element for an output drive movement from the hydraulic circuit.

6 Claims, 7 Drawing Sheets

HYDRAULIC MANIPULATOR

CROSS REFERENCE TO RELATED APPLICATIONS

Applicant claims priority under 35 U.S.C. §119 of German Application No. 198 57 378.2 filed Dec. 12, 1998. Applicant also claims priority under 35 U.S.C. §120 of PCT/DE99/03887 filed Dec. 12, 1998. The international application under PCT article 21(2) was not published in English.

A hydraulic actuation device for moving holder jaws arranged at intervals for rocket launching tubes is known from DE 32 28 655 C2. This known actuation device is a closed hydraulic circuit without a pressure tank unit. The actuation is realised manually using a lever on the transmitter cylinder of the hydraulic circuit. The transmitter cylinder is located inside an armoured vehicle and connected hydraulically with a working cylinder outside the vehicle, the piston of which in turn works the holder jaws with a rod. The actuation of the transmitter cylinder through a lever has ergonomic disadvantages and is restricted in resolution and power amplification.

The object of the invention is to create a cost-effective hydraulic manipulator with an ergonomic handling and a good transmission behaviour.

The manipulator, according to the invention, uses a rotary drive movement, which offers ergonomic advantages with respect to the achievable precision of movement and transmission of force to the output drive of the manipulator, particularly if high forces and very precise movements are required in the output. Some examples of such requirements are a vehicle steering, a ship control wheel, a hand wheel for adjusting a machine tool slide, a car jack, a cable winch, a rotary knob for angle adjustment to a theodolite or a telescope, a gas control rotary handle on a motorcycle or a volume control knob on the radio.

Other advantages of the manipulator according to the invention are that with a suitable selection of components, it is possible to keep the space requirement, the weight and the manufacturing costs low. The transmission of the manipulator can be realised through its design to be anything and can even take on large values, which make it possible to achieve higher positioning precision and greater working forces. Instead of manual exertion of the driving movements, an electrical motor can also be used, which can for example be connected directly to the drive shaft of the manipulator without an intermediate gearbox.

The figures explain embodiments of the invention in greater detail.

Figure 1:
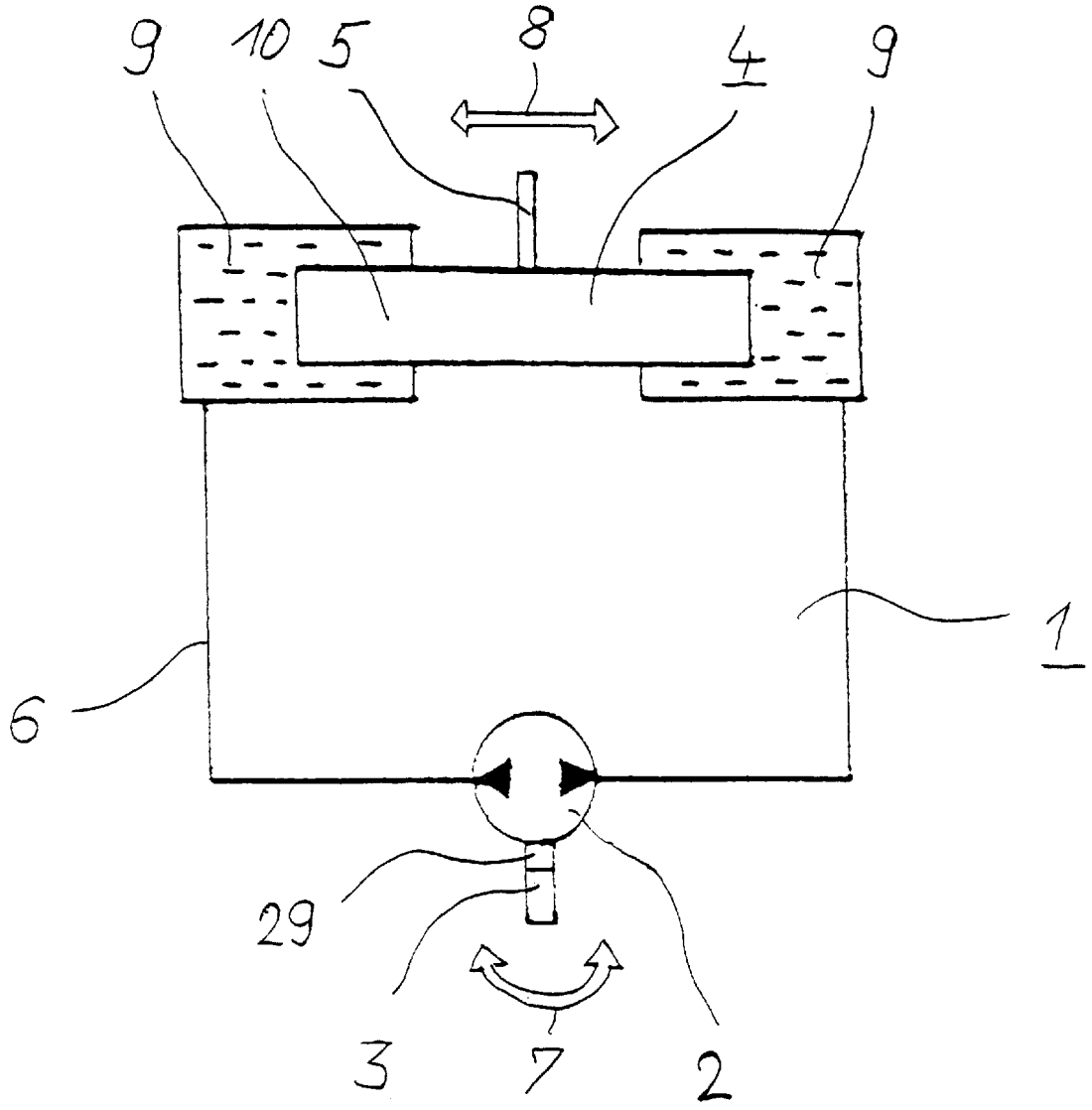
Figure 2A:
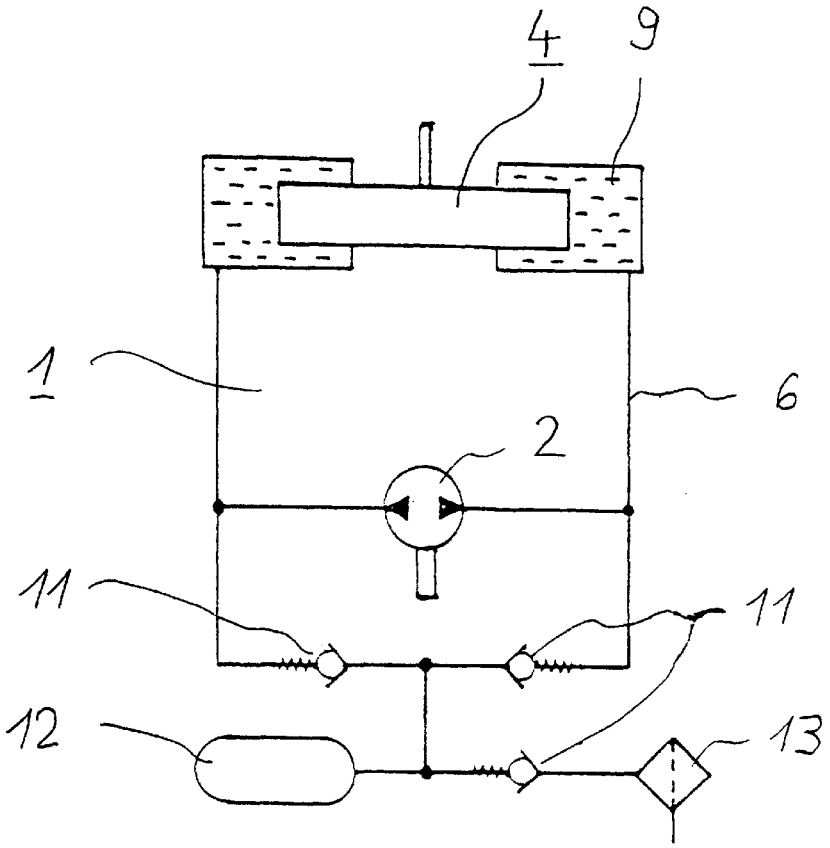
Figure 2B:
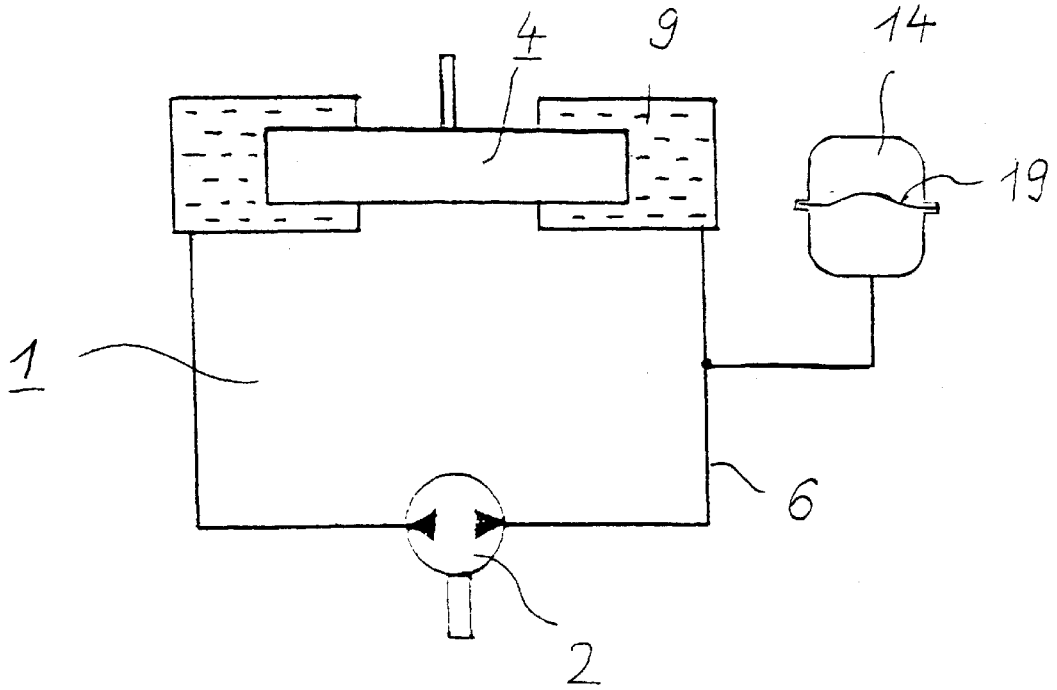
Figure 2C:
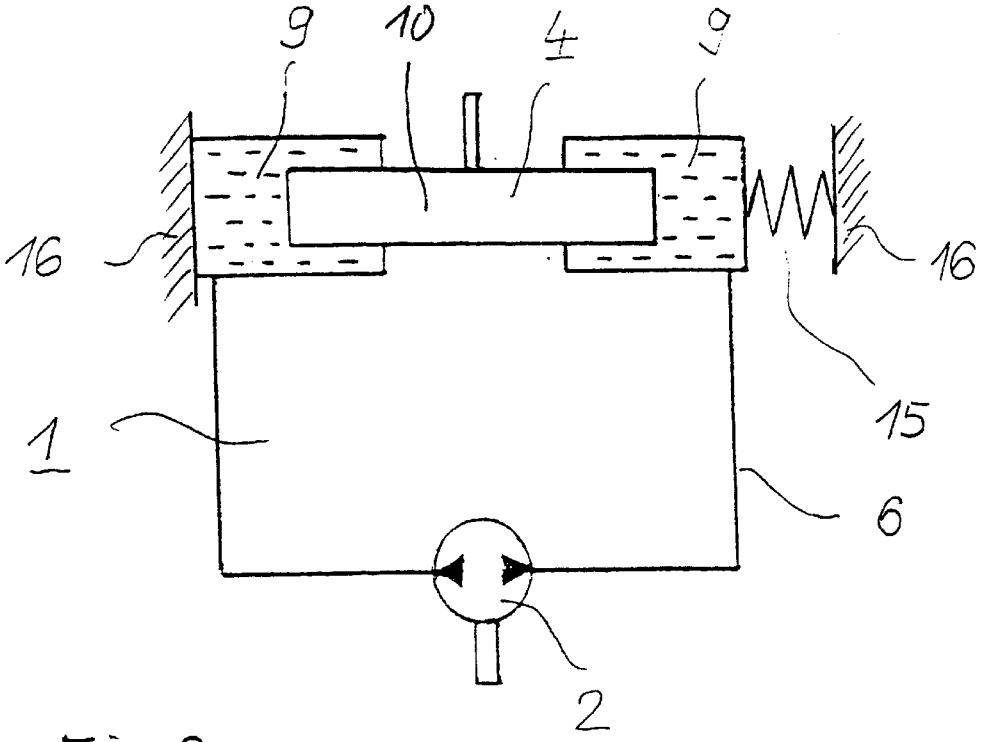
Figure 2D:
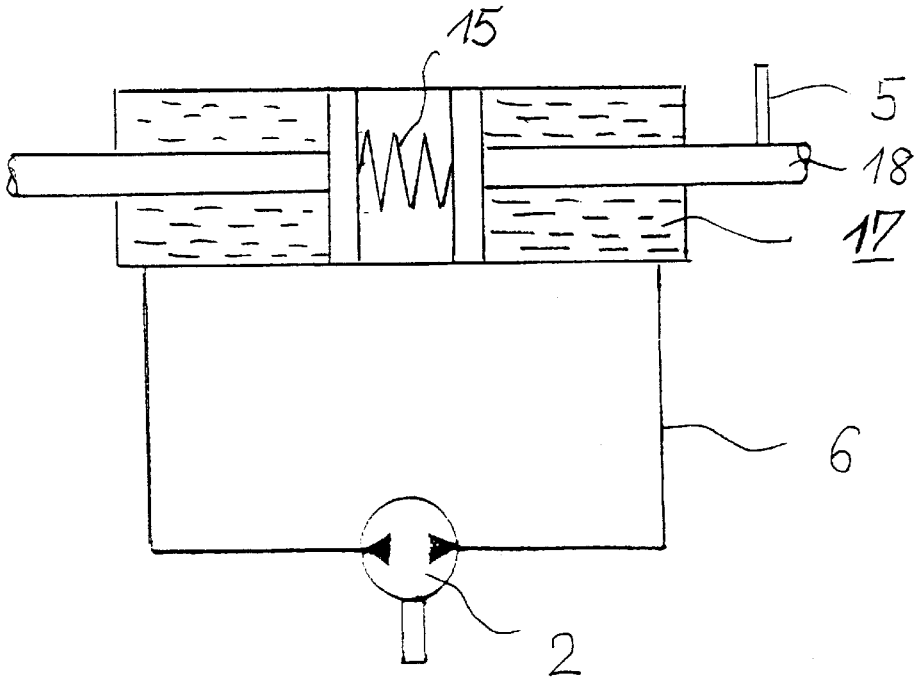
Figure 3:
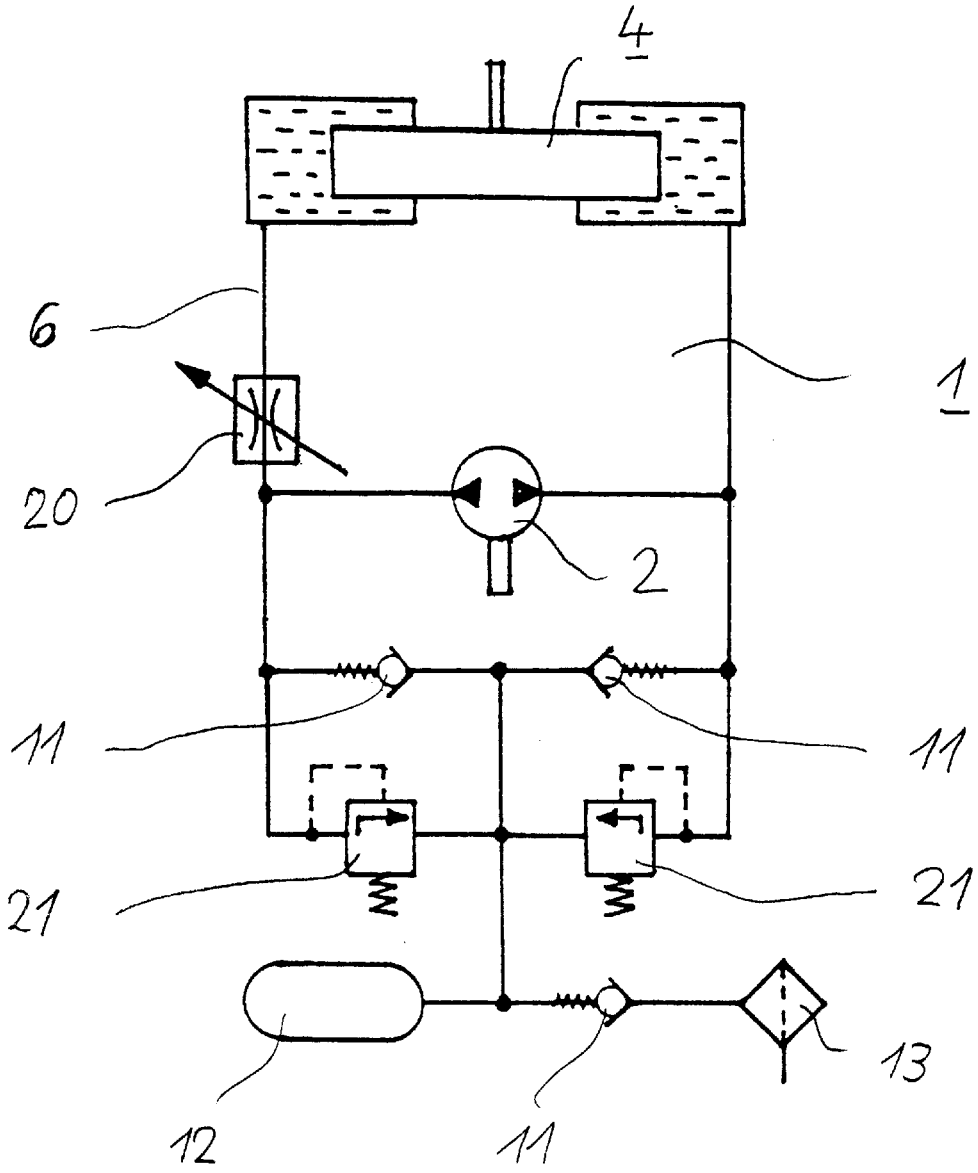
Figure 4:
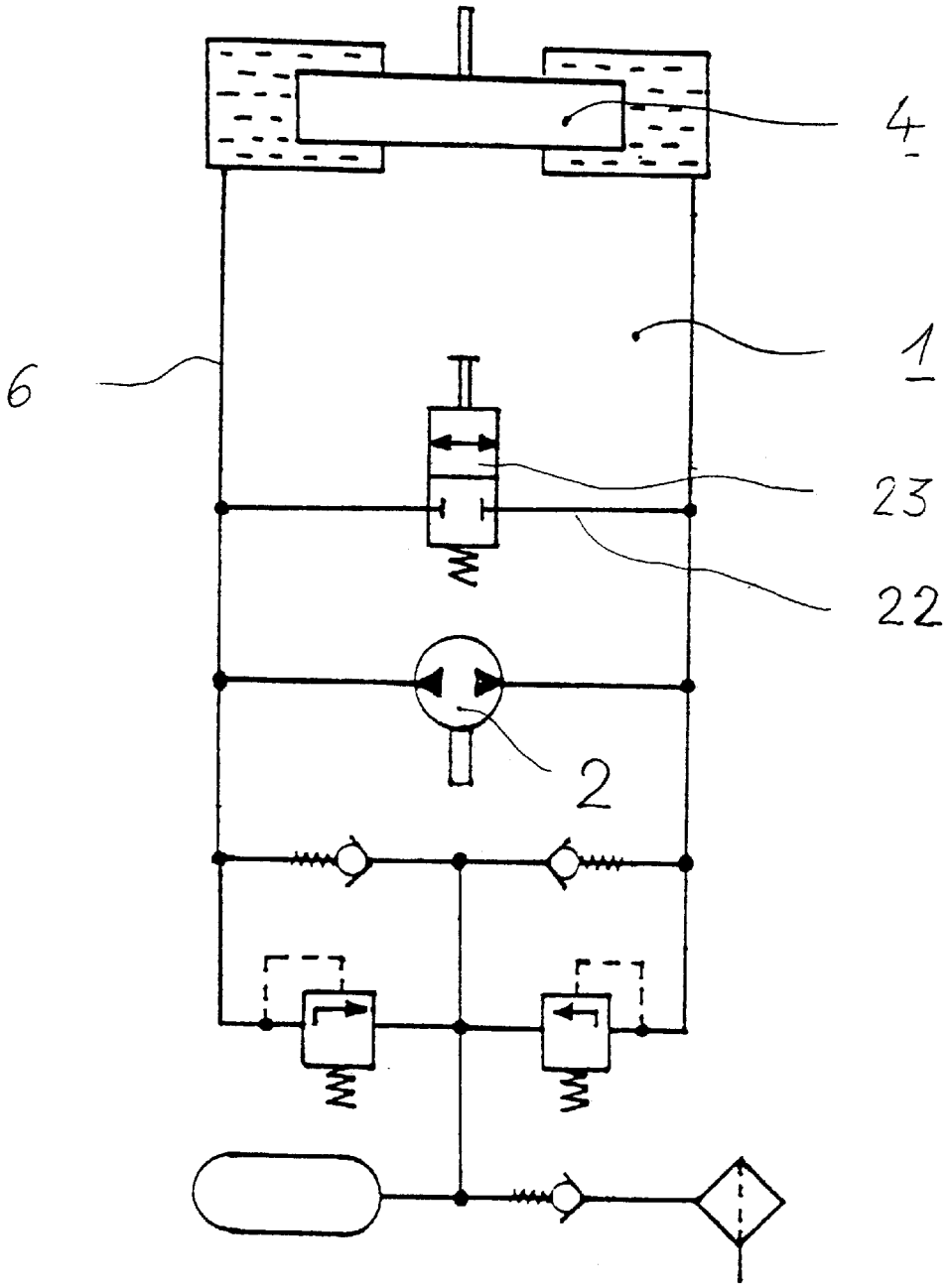
Figure 5:
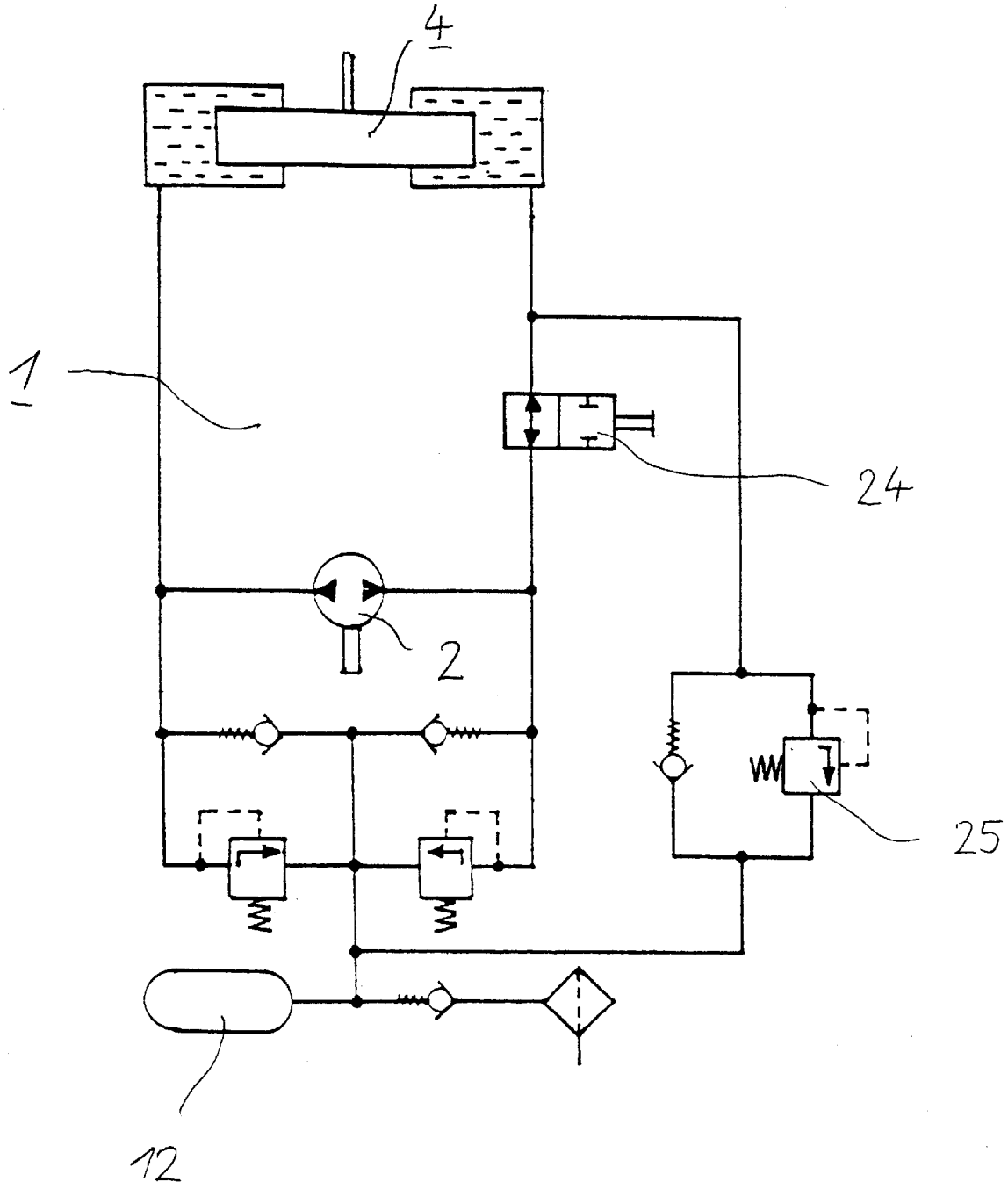
Figure 6:
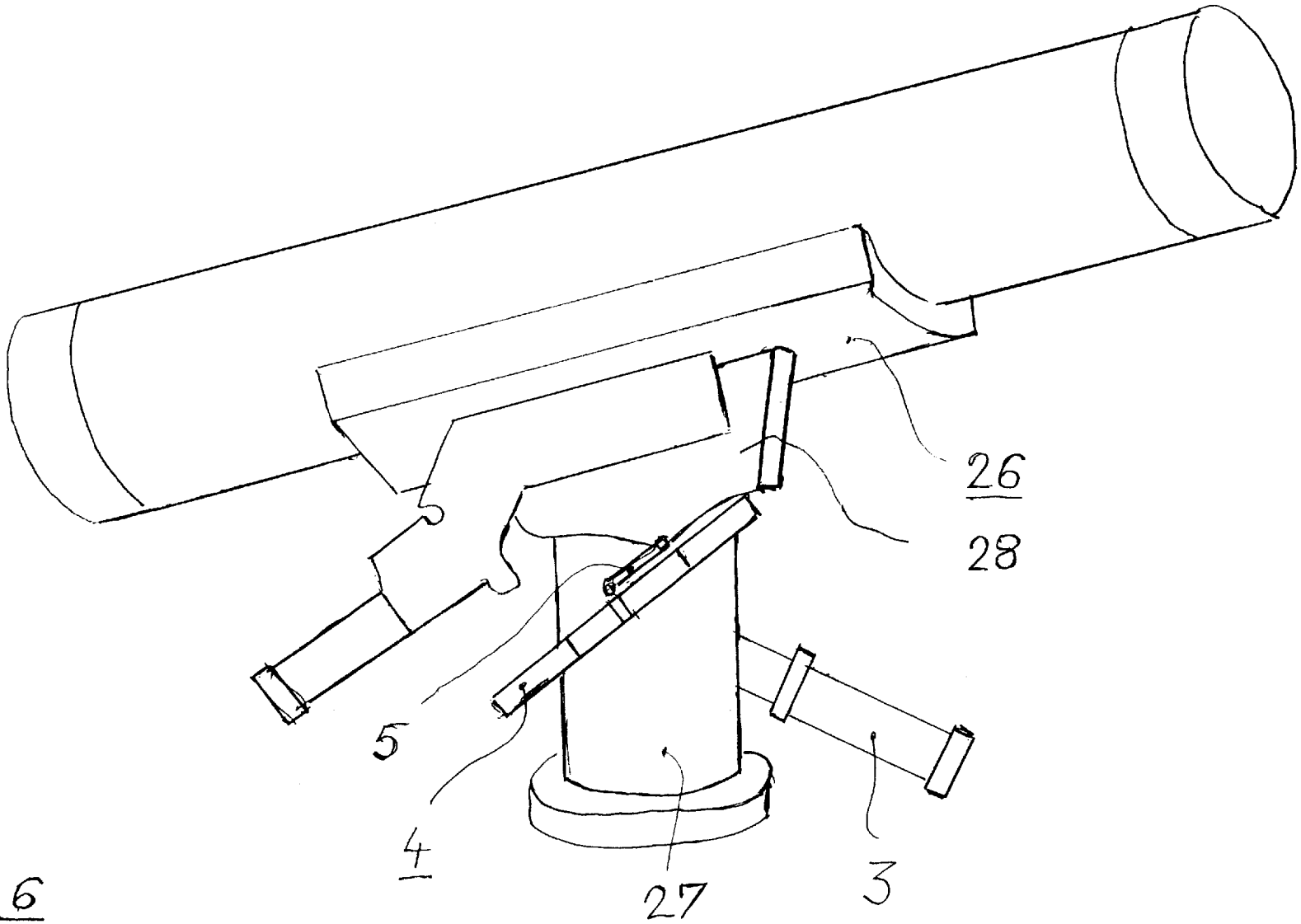

FIG. 1 shows a symbolic hydraulic circuit of a manipulator,

FIGS. 2*a* to 2*d* show means of compensating for the changes in the fluid volume on a manipulator, FIG. 3 shows a manipulator with a throttle for optimising the damping characteristics, FIG. 4 shows a manipulator with a bypass insert for quick readjustment, FIG. 5 shows a manipulator with means of fitting the drive input or output and FIG. 6 shows the use of a manipulator on a mobile anti-tank weapon.

The hydraulic manipulator shown in FIG. 1 consists of a closed hydraulic circuit 1 with a hydraulic pump 2, a rotary handle 3, a control element 4, a link element 5 and the hydraulic lines 6. Arrows for the direction of movement 7 and 8 show the input at the rotary handle 3 in the manipulator and the output at the link element 5 of the manipulator.

The. hydraulic pump 2 is a constant flow pump with two conveying directions. It is also possible to use a variable pump instead of the constant flow pump. The rotary handle 3 is connected to the drive shaft of the hydraulic pump 2 through a slipping link. The transmission ratio between the rotary handle 3 and the drive shaft, for this direct connection, is 1 to 1, but can be designed to be anything using an intermediate gearbox. In the example shown, the rotary handle 3 is actuated manually to effect a shift on the link element 5 on the output side. Actuation of the rotary handle can however also be executed through any other drive element, such as an electrical motor.

The pumped oil flow from the hydraulic pump 2 caused by actuating the rotary handle 3 produces a movement in the link element 5, through the hydraulic lines 6, at the output of the control element 4. In the example shown in FIG. 1, the control element 4 consists of two plunger cylinders 9 working in directions opposed to each other. The two plunger cylinders have a common piston 10. The piston 10 represents the drive output element of the manipulator, with the link element 5 functioning as the mechanical interface to the external elements.

Instead of the two plunger cylinders working in directions opposed to each other with one common piston, the control element 4 can also have other configurations, such as for example, as a double action hydraulic cylinder with translatory, rotary or combined transla-tory-rotary drive output movement. Further, it is also possible to have a configuration of the control element 4 as a variable hydraulic motor with two directions of flow and rotary drive output movement.

Changes could occur in the volume of hydraulic fluid in the closed hydraulic circuit 1, due to changes in temperature, leakage or compression, which change the pumped stream adjusted by means of the hydraulic pump. FIGS. 2*a* to 2*d* show means for automatic compensation for these changes in volume.

FIG. 2*a* shows a supplement to the hydraulic circuit 1 through a low-pressure hydraulic reservoir 12, which feeds hydraulic fluid into the hydraulic circuit 1 via pressure relief valve 11 in case of a reduction in volume in the hydraulic circuit. It is possible to refill the low-pressure hydraulic reservoir 12 itself through a filter 13 and an pressure relief valve 11.

FIG. 2*b* shows a supplement to the hydraulic circuit 1 through a high-pressure hydraulic reservoir 14, which feeds hydraulic fluid into the hydraulic circuit 1 via pressure-loaded membrane 19 in case of a reduction in volume in the hydraulic circuit. For this purpose, the membrane 19 is loaded in the reservoir with a gas cushion of about 70 bar.

FIG. 2*c* shows a change in the control element 4 in the hydraulic circuit 1. The piston 10 provides a floating support to one of the two plunger cylinders 9 of the control element 4, with a mechanical pressure spring 15 working on it. The pressure spring 15 and the other plunger cylinder 9 are supported on a rigid mounting 16.

FIG. 2*d* shows how the said version uses a mechanical pressure spring 16 for volume compensation in the hydraulic circuit 1. The pressure spring 15 is used in this solution between the halves of a piston 18 divided for this purpose. FIG. 2*d* shows a two-sided hydraulic cylinder 17 as control element 4. However, the solution can also be used for other hydraulic cylinders, for example for the plunger cylinder system shown earlier.

The manipulator shown in FIG. 3 has integrated a variable throttle 20 in the hydraulic circuit 1. This has an effect on the damping characteristic of the manipulator. For purposes of fine settings, this is a means to improve the ergonomic aspect.

FIG. 3 further shows a means for hydraulic fluid volume compensation as described earlier in FIG. 2*a*, consisting of a low-pressure hydraulic reservoir 12 and pressure relief valves 11. The hydraulic circuit shown also includes two pressure limiting valves 21, which offer a cost effective excess pressure protection in both directions of rotation of the manipulator, instead of a slipping link located on the rotary handle 3.

It should be pointed out that the adjustable throttle 20, deviating from the manipulator shown in FIG. 3, can be used without restrictions without the volume compensation devices shown in FIG. 3, as well as without the shown pressure limiting valves 21 for the damping characteristic.

The manipulator shown in FIG. 4 corresponds to the manipulator shown in FIG. 3 earlier, except for an additional bypass 22 on the hydraulic pump 2, which can be connected or disconnected from a pilot valve 23. In case of a disconnected, i.e. closed bypass 22, there can be a quick action adjustment between the drive input and output of the manipulator, in relation to the connected, i.e. open bypass 22.

If the drive input or output is to be locked in a certain position, it is possible to interrupt the hydraulic circuit 1 by means of a pilot valve 24. Continued operations of the hydraulic pump 2 after interrupting the hydraulic circuit 1 will be without effect due to a pressure limiting valve 25 that is connected in parallel to the pilot valve 24 and that feeds into the low pressure hydraulic reservoir 12. Cancelling the locked position can be achieved by opening the pilot valve 24.

FIG. 6 shows the application of the manipulator according to the invention on a mobile anti-tank weapon 26. The manipulator helps make the elevation alignment movement of the anti-tank weapon manually. While sighting, the drive input shaft 29 of the hydraulic pump 2, not recognisable in FIG. 6, is moved in different directions according to the sighting process, using the rotary handle 3 of the manipulator integrated in the foot 27 of the anti-tank weapon. Both connections of the hydraulic pump 2 are connected with the control element 4 that is attached on the outside to the foot and that acts through the link element 5 on the launching platform 28 and swivels the platform about the rotary axis of elevation upon operation of the rotary handle 3. The control element 4 consists of plunger cylinders 9 working reciprocally, in which a common piston 10 slides.

All hydraulic lines 6 are contained in the foot 27, which is formed as a precision cast housing part. Most of the components of the hydraulic circuit 1, such as valves, throttle and filters are miniature components, in sizes with a diameter of approximately 6 mm and a length of 27 mm. They are integrated in the precision cast housing in a pressing operation.

The foot 27 contains, in addition to the components described earlier, also the azimuth damping and azimuth bearing, which are carried out in the usual manner and are not within the scope of this invention.

The rotary handle 3 is designed as an elevation adjustment handle in this version and consists of the following parts: Handle, bearing, structure, shaft and slipping link. The slipping link serves as excess pressure protection in both the directions of operation. The operation of the slipping link can also be executed hydraulically with the use of pressure limiting valves to help save on weight, see FIG. 3. The advantage of using a slipping link in this type of application is that it is more cost-effective.

The transmission ratio of movements of the drive shaft of the hydraulic pump 2 and the link element 5 are optimised in relation to the sighting properties by designing the components of the hydraulic circuit 1 appropriately. The position of the rotary axis of the elevation adjustment handle can be freely selected on the foot 27 by using the manipulator according to the invention. It is optimised in the ergonomical aspects and is rigidly placed in the foot 27.

In comparison with the anti-tank weapons, which execute the elevation movement through a mechanical elevating and traversing mechanism, use of the manipulator according to the invention incurs lower technical and financial expenditure. The three-dimensional spatial arrangement of the elevation adjustment handle, required for ergonomic reasons, and the transfer of the output movement to the ramp 28 of the anti-tank weapon that is created at this elevation adjustment handle is solved in a cost-effective manner solely by appropriate routing of the hydraulic lines in the foot 27.

The hydraulic principle helps achieve higher drive rigidity, better damping behaviour and lower friction, compared to a purely mechanical drive. All the above-mentioned advantages provide a better sighting quality. Further, the design freedom afforded by the hydraulic manipulator is linked to special advantages, such as reducing the size of the elevation bearing by splitting this bearing into two parts or a higher placement of the axis of elevation.

What is claimed is:

1. A hydraulic manipulator for a hydraulic system comprising:

a) a closed hydraulic circuit;

b) a drive element for introducing an input drive movement into said closed hydraulic circuit;

c) a control element for creating an output drive movement from said closed hydraulic circuit, said control element having a plunger cylinder which has a floating support which is supported in its longitudinal axis against a rigid mounting, the device further comprising a pressure spring for supporting said plunger cylinder to compensate for volumetric changes; and d) a storage means that includes a pressurized high-pressure hydraulic fluid reservoir connected directly to said closed hydraulic circuit;

wherein the geometric volume of the hydraulic system does not change upon movement of the moveable parts of said closed hydraulic circuit;

wherein said drive element is a hydraulic pump with two feed directions that are directly connected with said control element, and said hydraulic pump has a drive input shaft; and wherein a set of input drive movements are introduced at the drive input shaft of the hydraulic pump as a rotary movement.

2. The hydraulic manipulator as in claim 1, wherein said hydraulic pump is a constant flow pump.

3. The hydraulic manipulator as in claim 1, wherein said hydraulic pump is a variable pump.

4. The hydraulic manipulator as in claim 1, wherein said hydraulic pump is a manually operated pump.

5. A hydraulic manipulator for a hydraulic system comprising:

a) a closed hydraulic circuit;

b) a drive element for introducing an input drive movement into said closed hydraulic circuit;

c) a control element for creating an output drive movement from said closed hydraulic circuit;

d) a divided piston comprising at least two piston elements being divided by a gap, and a spring disposed in said gap between said at least to piston elements;

e) storage means that includes a pressurized high-pressure hydraulic fluid reservoir connected directly to said closed hydraulic circuit;

wherein said divided piston compensates for changes in fluid volume and said at least two piston elements are pressed away from each other against fluid pressure via said spring;

wherein the geometric volume of the hydraulic system does not change upon movement of the moveable parts of said closed hydraulic circuit;

wherein said drive element is a hydraulic pump with two feed directions that are directly connected with said control element, and said hydraulic pump has a drive input shaft; and wherein a set of input drive movements are introduced at the drive input shaft of the hydraulic pump as a rotary movement.

6. The hydraulic manipulator as in claim 5, wherein said control element is formed as a two part plunger cylinder which acts as a double action hydraulic cylinder.

* * * * *

UNITED STATES PATENT AND TRADEMARK OFFICE

CERTIFICATE OF CORRECTION

PATENT NO. : 6,591,607 B1
DATED : July 15, 2003
INVENTOR(S) : Baumgarten

It is certified that error appears in the above-identified patent and that said Letters Patent is hereby corrected as shown below:

Column 5,
Line 10, after the word "least", please change the word "to" to -- two --.

Signed and Sealed this

Twenty-ninth Day of June, 2004

JON W. DUDAS
*Acting Director of the United States Patent and Trademark Office*